US008809244B2

(12) United States Patent
Raguz et al.

(10) Patent No.: US 8,809,244 B2
(45) **Date of Patent: *Aug. 19, 2014**

(54) LUBRICANTS CONTAINING AROMATIC DISPERSANTS AND TITANIUM

(75) Inventors: Mary Galic Raguz, Mentor, OH (US); Virginia A. Carrick, Chardon, OH (US); John K. Pudelski, Cleveland Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/818,172

(22) PCT Filed: Aug. 22, 2011

(86) PCT No.: PCT/US2011/048582

§ 371 (c)(1),
(2), (4) Date: May 30, 2013

(87) PCT Pub. No.: WO2012/027254

PCT Pub. Date: Mar. 1, 2012

(65) Prior Publication Data

US 2014/0148370 A1 May 29, 2014

Related U.S. Application Data

(60) Provisional application No. 61/375,993, filed on Aug. 23, 2010.

(51) Int. Cl.

| | |
|---|---|
| ***C10M 169/04*** | (2006.01) |
| ***C10M 113/08*** | (2006.01) |
| ***C10M 149/12*** | (2006.01) |

(52) U.S. Cl.
USPC ..... 508/165; 508/192; 508/563

(58) Field of Classification Search
USPC ..... 508/364, 192, 165, 563
See application file for complete search history.

(56) References Cited

U.S. PATENT DOCUMENTS

| | | | | |
|---|---|---|---|---|
| 7,615,520 | B2 | 11/2009 | Esche | |
| 7,727,943 | B2 * | 6/2010 | Brown et al. | 508/165 |
| 8,268,759 | B2 * | 9/2012 | Brown et al. | 508/165 |
| 2005/0025316 | A1 * | 2/2005 | Pelly et al. | 380/277 |
| 2006/0025316 | A1 | 2/2006 | Covitch et al. | |
| 2006/0189492 | A1 | 8/2006 | Bera et al. | |
| 2006/0217271 | A1 * | 9/2006 | Brown et al. | 508/165 |
| 2011/0306528 | A1 * | 12/2011 | Gieselman et al. | 508/261 |

FOREIGN PATENT DOCUMENTS

| | | |
|---|---|---|
| WO | 2006/015130 | 2/2006 |
| WO | 2009/042590 | 4/2009 |
| WO | 2010/039602 | 4/2010 |
| WO | 2010/062842 | 6/2010 |

OTHER PUBLICATIONS

Corresponding International Publication No. WO 2012/027254 A1 and Search Report published Mar. 1, 2012.
Written Opinion from corresponding International Application No. PCT/US2011/048582 dated Oct. 14, 2011.

* cited by examiner

*Primary Examiner* — Jim Goloboy
(74) *Attorney, Agent, or Firm* — David M. Shold, Esq.; Michael F. Esposito, Esq.

(57) ABSTRACT

A lubricant composition, comprising an oil of lubricating viscosity, a dispersant comprising the condensation product of a carboxylic-functionalized polymer with an aromatic moiety through an amide, imide, or ester linkage, and an oil-soluble titanium compound, exhibits good oxidative stability.

19 Claims, No Drawings

LUBRICANTS CONTAINING AROMATIC DISPERSANTS AND TITANIUM

BACKGROUND OF THE INVENTION

The disclosed technology relates to lubricants with good oxidative stability, containing a combination of an oil-soluble titanium compound and a condensation product of a carboxylic-functionalized polymer with an aromatic moiety.

Engine manufacturers have focused on improving engine design in order to minimize emissions of particulates, emissions of other pollutants, and also improve cleanliness, fuel economy, and efficiency. One of the improvements in engine design is the use of exhaust gas recirculation (EGR) engines. While improvements in engine design and operation have contributed to reducing emissions, some engine design advances are believed to have generated other challenges for the lubricant. For example, EGR is believed to have led to increased formation and/or accumulation of soot and sludge.

Soot-mediated oil thickening is common in heavy duty diesel engines. Some diesel engines employ EGR. The soot formed in an EGR engine has different structures and causes increased viscosity of engine lubricant at lower soot levels than soot formed in an engine without an EGR. Attempts to alleviate soot-mediated oil thickening have included the use of dispersants containing aromatic functionality, as disclosed, for instance, in PCT publication WO2010/062842, Jun. 3, 2010; US Application 2006-0025316, Covitch et al., Feb. 2, 2006; or US Application 2006-0189492, Bera et al., Aug. 24, 2006.

At the same time, there has been continuing interest in providing crankcase lubricants meeting government specifications such as reduced sulfur and phosphorus limits. It is widely believed that lowering these limits may have a serious impact on engine performance, engine wear, and oxidation of engine oils. This is because historically a major contributor to phosphorus content in engine oils has been zinc dialkyldithiophosphate (ZDP), and ZDP has long been used to impart antiwear and antioxidancy performance to engine oils. Thus, as reduced amounts of ZDP are anticipated in engine oils, there is a need for alternatives to impart protection against deterioration in one or more of the properties of engine performance, engine wear, and oxidation of engine oils. Such improved protection is desirable whether or not ZDP and related materials are included in the lubricant. Lubricants addressing these issues have been formulated containing oil-soluble titanium compounds, as disclosed in U.S. Pat. No. 7,727,943, Brown et al., Jun. 1, 2010, and U.S. Pat. No. 7,615,520, Esche, J R, Nov. 10, 2009.

There remains a need, however, for lubricants having good or improved properties such as described above, including further improved oxidative stability. The technology disclosed herein provides a lubricant having one or more of such properties.

SUMMARY OF THE INVENTION

The disclosed technology provides a lubricant composition, comprising (a) an oil of lubricating viscosity; (b) a dispersant comprising the condensation product of a carboxylic functionalized polymer with an aromatic moiety through an amide, imide, or ester linkage; and (c) an oil-soluble titanium compound.

The disclosed technology further provides a method for lubricating a mechanical device comprising supplying to said device the above lubricant composition.

The disclosed technology further provides a method for improving the oxidative stability of a lubricant for a mechanical device, comprising including within said lubricant (b) a dispersant comprising the condensation product of a carboxylic-functionalized polymer with an aromatic moiety through an amide, imide, or ester linkage; and (c) an oil-soluble titanium compound.

DETAILED DESCRIPTION OF THE INVENTION

Various preferred features and embodiments will be described below by way of non-limiting illustration.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is found in paragraphs [0118] to [0119] of International Publication WO2008147704.

One component of the disclosed technology is an oil of lubricating viscosity. The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Visc. Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | >120 |
| Group IV | All polyalphaolefins (PAOs) | | | |
| Group V | All others not included in Groups I, II, III or IV. | | | |

In one embodiment, the base oil as used in the present technology has less than 300 ppm sulfur and/or at least 90% saturate content, by ASTM D2007. In certain embodiments, the base oil has a viscosity index of at least 95 or at least 115.

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil, and other vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, constitute other classes of known synthetic lubricating oils that can be used. Another suitable class of synthetic lubricating oils that can be used comprises the esters of dicarboxylic acids and those made from C5 to C12 monocarboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Hydrotreated naphthenic oils are also known and can be used. Synthetic oils may be used, such as those produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The amount of oil in a fully formulated lubricant will typically be the amount remaining to equal 100 percent after the remaining additives are α-counted for. Typically this may be 60 to 99 percent by weight, or 70 to 97 percent, or 80 to 95 percent, or 85 to 93 percent. The disclosed technology may also be delivered as a concentrate, in which case the amount of oil is typically reduced and the concentrations of the other components are correspondingly increased. In such cases the amount of oil may be 30 to 70 percent by weight or 40 to 60 percent.

Polymeric Dispersant

The lubricating composition of the invention contains a dispersant comprising the condensation product of a carboxylic functionalized polymer with an aromatic moiety through an amide, imide, or ester linkage. That is, it may be a condensation product with an aromatic amine of any of a variety of types. If the condensation is through the nitrogen atom of the aromatic amine, an amide or imide linkage may result. Alternatively, the dispersant may be the condensation product with an aromatic alcohol or phenol of any of a variety of types (including esters which may be considered to be a reactive equivalent to an alcohol or phenol). If the condensation is through the oxygen atom of the aromatic alcohol or phenol, an ester linkage may results. If the aromatic compound contains both amine and alcohol functionality, then any of an amide, imide, or ester may result, or mixtures thereof, depending on reaction conditions and on whether the reaction occurs primarily at the amine or alcohol group.

In certain embodiments, the dispersant comprises a polymer functionalized with a certain type of amine. The amine used for the polymeric dispersant is typically an amine having at least 2 or at least 3 or at least 4 aromatic groups, for instance, 4 to 10 or 4 to 8 or 4 to 6 aromatic groups, and at least one primary or secondary amino group or, alternatively, at least one secondary amino group. In some embodiments the amine comprises both a primary and at least one secondary amino group. In certain embodiments, the amine comprises at least 4 aromatic groups and at least 2 secondary or tertiary amino groups (that is, any combination of secondary and/or tertiary amino groups totalling at least 2).

As used herein the term "aromatic group" is used in the ordinary sense of the term and is known to be defined by Hückel theory of 4n+2 π electrons per ring system. Accordingly, one aromatic group of the invention may have 6, or 10, or 14 π electrons. A benzene ring has 6 π electrons, a naphthalene ring has 10 π electrons, and an acridine group has 14 π electrons.

An example of an amine having 2 aromatic groups is N-phenyl-p-phenylenediamine (also referred to as 4-aminodiphenylamine, ADPA). An example of an amine having at least 3 or 4 aromatic groups may be represented by Formula (1):

Formula 1

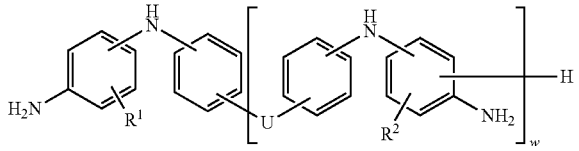

wherein, independently, each variable is as follows: $R^1$ may be hydrogen or a $C_{1-5}$ alkyl group (typically hydrogen); $R^2$ may be hydrogen or a $C_{1-5}$ alkyl group (typically hydrogen); U may be an aliphatic, alicyclic or aromatic group (when U is aliphatic, the aliphatic group may be a linear or branched alkylene group containing 1 to 5, or 1 to 2 carbon atoms); and w may be 1 to 10, or 1 to 4, or 1 to 2 (typically 1). In one embodiment, when U is an aliphatic group, U is in particular an alkylene groups containing 1 to 5 carbon atoms.

An example of the amine having at least 3 or 4 aromatic groups may be represented alternatively by a structure as shown in Formula (1a):

Formula 1a

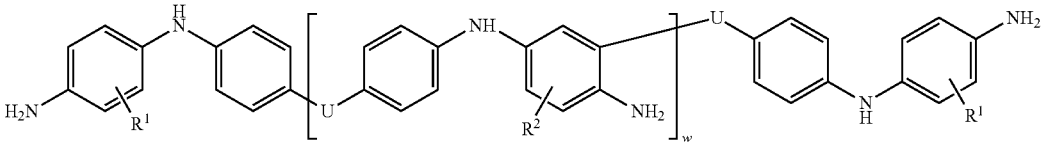

wherein each variable U, $R^1$, and $R^2$ are the same as described above and w is, in this representation, 0 to 9 or 0 to 3 or 0 to 1 (typically 0).

Further examples of an amine having at least 3 or 4 aromatic groups may be represented by any of the following Formulas (2) and/or (3):

Formula (2)

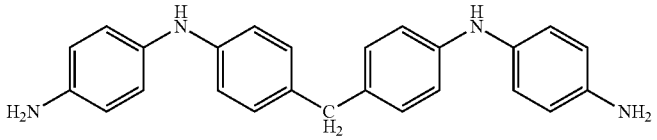

Formula (3)

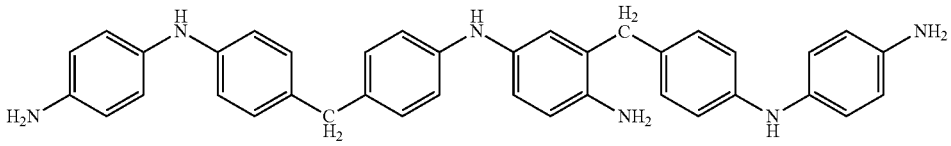

Isomers with various placements of amino groups relative to alkylene bridges are also possible, including, as only one example, that of Formula (2x):

Formula (2x)

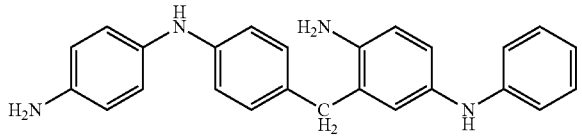

In one embodiment an amine having at least 3 or 4 aromatic groups may include mixtures of compounds represented by the formulas disclosed above. A person skilled in the art will appreciate that compounds of Formulas (2) and (3) may also react with the aldehyde described below to form acridine derivatives, including those represented by Formula (2a) or (3a) to (3c) below. In addition to the compounds represented these formulas, other acridine structures may be possible where the aldehyde reacts with other with benzyl groups bridged with the >NH group.

Formula (2a)

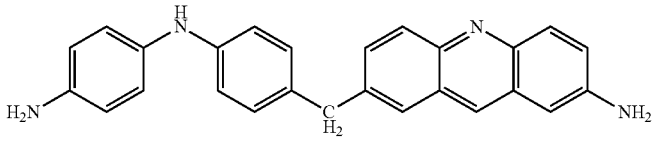

Formula (3a)

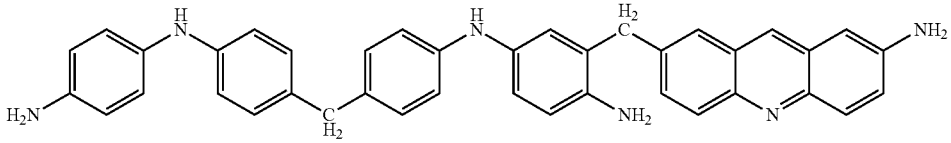

Any or all of the N-bridged aromatic rings are capable of such further condensation and perhaps aromatization. One other of many possible structures is shown in Formula (3b).

Formula (3b)

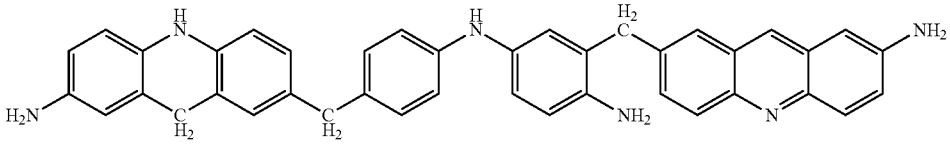

Formula (3c)

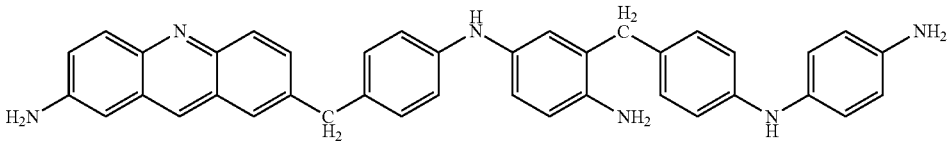

Any of the formulas (2), (2a) (3), or (3a) to (3c) could also have further condensation reactions occurring resulting in one or more acridine moieties forming per molecule.

Examples of the amine having at least 3 or 4 aromatic groups include bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine, N-4-{4-[4-(4-amino-phenylamino)-benzyl]-phenyl}-2-[4-(4-amino-phenylamino)cyclohexa-1,5-dienylmethyl]-benzene-1,4-diamine, N-[4-(7-amino-acridin-2-ylmethyl)-phenyl]-benzene-1,4-diamine, and mixtures thereof. In one embodiment the amine having at least 3 or 4 aromatic groups may be bis[p-(p-aminoanilino)phenyl]-methane, 2-(7-amino-acridin-2-ylmethyl)-N-4-{4-[4-(4-aminophenylamino)-benzyl]-phenyl}-benzene-1,4-diamine or mixtures thereof.

The amine having at least 2 or 3 or 4 aromatic groups may be prepared by a process comprising reacting an aldehyde with an amine (typically 4-aminodiphenylamine). The resultant amine may be described as an alkylene coupled amine having at least 2 or 3 or 4 aromatic groups, in certain embodiments, at least one —$NH_2$ functional group and at least 2 secondary or tertiary amino groups. The aldehyde used for the coupling may be aliphatic, alicyclic, or aromatic. The aliphatic aldehyde may be linear or branched. Examples of suitable aromatic aldehydes include benzaldehyde and o-vanillin. Examples of aliphatic aldehydes include formaldehyde (or a reactive equivalent thereof such as formalin or paraformaldehyde), ethanal, and propanal. Typically the aldehyde may be formaldehyde or benzaldehyde. Alternatively, the amine having at least 3 or 4 aromatic groups may also be prepared by the methodology described in *Berichte der Deutschen Chemischen Gesellschaft* (1910), 43, 728-39.

In one embodiment the amine having at least 3 or 4 aromatic groups may be obtained or obtainable by a process comprising reacting isatoic anhydride or alkyl substituted isatoic anhydride, with an aromatic amine with at least two aromatic groups and a reactive primary or secondary amino group. The resultant material may be described as an anthranilic derivative.

In one embodiment the anthranilic derivative may be prepared by reacting isatoic anhydride or alkyl substituted isatoic anhydride and an aromatic amine selected from the group consisting of xylylenediamine, 4-aminodiphenylamine, 1,4-dimethylphenylenediamine, and mixtures thereof. In one embodiment the aromatic amine may be 4-aminodiphenylamine.

The process described above to prepare the anthranilic derivative may be carried out at a reaction temperature in the range of 20° C. to 180° C., or 40° C. to 110° C. The process may (or may not) be carried out in the presence of a solvent. Examples of suitable solvents include water, diluent oil, benzene, t-butyl benzene, toluene, xylene, chlorobenzene, hexane, tetrahydrofuran, or mixtures thereof. The reactions may be performed in either air or an inert atmosphere such as nitrogen or argon, typically nitrogen.

In other embodiments, the aromatic amine may be a nitro-substituted aromatic amine. Examples of nitro-substituted aromatic amines include 2-nitroaniline, 3-nitroaniline, and 4-nitroaniline. 3-nitroaniline is particularly useful. Other aromatic amines may be present along with the nitroaniline. Condensation products with nitroaniline and optionally also with Disperse Orange 3 (that is, 4-(4-nitrophenylazo)aniline) are known from US Patent Application 2006-0025316, Covitch et al., published Feb. 2, 2006.

Carboxylic Functionalized Polymer

The dispersant of the present technology may be the reaction product of the aromatic amine or alcohol, described above, with a carboxylic functionalized polymer. The resultant product may be described as being an amine-functionalized carboxylic functionalized polymer. The carboxylic functionalized polymer may comprise an olefin polymer bearing one or more carboxylic (or equivalent) groups. The carboxylic functionalized polymer backbone may be a homopolymer or a copolymer, provided that it contains at least one carboxylic acid functionality or a reactive equivalent of carboxylic acid functionality (e.g., anhydride or ester). The carboxylic functionalized polymer may have a carboxylic acid functionality (or a reactive equivalent of carboxylic acid functionality) grafted onto the backbone, within the polymer backbone or as a terminal group on the polymer backbone.

The carboxylic functionalized polymer may be a polyisobutylene-substituted succinic anhydride, a maleic anhydride-styrene copolymer, an ester of a maleic anhydride-styrene copolymer, an alpha olefin-maleic anhydride copolymer, or a maleic anhydride graft copolymer of (i) a styrene-ethylene-alpha olefin polymer, (ii) a hydrogenated alkenyl aryl conjugated diene copolymer (that is, a hydrogenated alkenyl arene conjugated diene copolymer, in particular a hydrogenated copolymer of styrene-butadiene), (iii) a polyolefin grafted with maleic anhydride (in particular ethylene-propylene copolymer), or (iv) a isoprene polymer (in particular non-hydrogenated isobutylene-isoprene copolymer or a hydrogenated styrene-isoprene polymer), or mixtures thereof.

The carboxylic functionalized polymer described herein is known in lubricant technology. For example esters of maleic anhydride and styrene-containing polymers are known from U.S. Pat. No. 6,544,935. Grafted styrene-ethylene-alpha olefin polymers are taught in International publication WO 01/30947. Copolymers derived from isobutylene and isoprene have been used in preparing dispersants and are reported in International publication WO 01/98387. Grafted styrene-butadiene and styrene-isoprene copolymers are described in a number of references including DE 3,106,959; and U.S. Pat. Nos. 5,512,192, and 5,429,758. Polyisobutylene succinic anhydrides have been described in numerous publications including U.S. Pat. Nos. 4,234,435; 3,172,892; 3,215,707; 3,361,673; and 3,401,118. Grafted ethylene-propylene copolymers have been described in U.S. Pat. Nos. 4,632,769; 4,517,104; and 4,780,228. Esters of (alpha-olefin maleic anhydride) copolymers have been described in U.S. Pat. No. 5,670,462. Copolymers of isobutylene and conjugated dienes (such as isobutylene-isoprene copolymer) have been described in U.S. Pat. Nos. 7,067,594 and 7,067,594 and US Patent Application US 2007/0293409. Terpolymers of ethylene, propylene and non-conjugated diene (such as dicyclopentadiene or butadiene) are described in U.S. Pat. Nos. 5,798,420 and 5,538,651. Typically the polymers mentioned in this paragraph that contain diene monomers (e.g., butadiene or isoprene) are partially or wholly hydrogenated. Many of the polymer backbones are also described in "Chemistry and Technology of Lubricants, Second Edition, edited by R. M. Mortier and S. T. Orszulik, published by Blackie Academic & Professional. In particular pages 144-180 discuss many of the polymer backbones (i)-(iv) and (vi)-(viii).

The polymer backbone (other than a polyisobutylene) of the present invention may have a number average molecular weight (by gel permeation chromatography, polystyrene standard), which may be up to 150,000 or higher, e.g., 1,000 or 5,000 to 150,000 or to 120,000 or to 100,000. An example of a suitable number average molecular weight range includes 10,000 to 50,000, or 6,000 to 15,000, or 30,000 to 50,000. In one embodiment, the polymer backbone has a number average molecular weight of greater than 5,000, for instance, greater than 5000 to 150,000. Other combinations of the above-identified molecular weight limitations are also contemplated. When the polymer backbone of the invention is a polyisobutylene, its number average molecular weight (by gel permeation chromatography, polystyrene standard), may be 350 to 15,000, or 550 to 10,000, or 500 to 10,000, or 750 to 5000 or 750 to 2500. (Thus, a polyisobutylene succinic anhydride may be derived from a polyisobutylene with any of the foregoing molecular weights.) Certain commercially available polyisobutylene polymers have a number average molecular weight of 550, 750, 950-1000, 1550, 2000, or 2250. Some of the commercially available polyisobutylene polymers may obtain the number average molecular weights shown above by blending one or more polyisobutylene polymers of different weights. In one embodiment, the carboxylic functionalized polymer comprises a polyisobutylene of number average molecular weight of about 500 to about 10,000 bearing at least one grafted succinic group (typically from a reaction of the polyisobutylene with maleic anhydride).

In one embodiment the product may be obtained or obtainable by reacting a carboxylic functionalised polymer with an amine-functionalised additive having at least 2 or 3 or 4 aromatic groups, at least one —$NH_2$ functional group, and at least 2 secondary or tertiary amino groups. The amine-functionalized additive having at least 2 or 3 or 4 aromatic groups may be reacted with the carboxylic functionalized polymer under reaction conditions that will be well known to a person skilled in the art for forming imides and/or amides of carboxylic functionalized polymers.

The amine-functionalized carboxylic functionalized polymer obtained or obtainable by reacting a carboxylic functionalised polymer with an amine having at least 2 or 3 or 4 aromatic groups, at least one —$NH_2$ functional group, and at least 2 secondary or tertiary amino groups may, in certain embodiments, be represented by the Formulas (4) and/or (5): wherein, independently, each variable $R^1$, $R^2$ and U are as described previously. BB represents a polymer backbone and may be polyisobutylene (PIB), or alternatively copolymers of (i) hydrogenated alkenyl aryl conjugated diene copolymers (in particular hydrogenated copolymers of styrene-butadiene), (ii) polyolefins (in particular ethylene-α olefins such as ethylene-propylene copolymers), (iii) hydrogenated isoprene polymers (in particular hydrogenated styrene-isoprene polymers), or (iv) a copolymer of isoprene and isobutylene. BB may be substituted with one succinimide group as shown in formulas (4) and (5), or it may be substituted by multiple succinimide groups. In one embodiment BB may be a copolymer of isoprene and isobutylene. The amine moieties shown in formulas (4) and (5) may also be replaced, in whole, or in part, by corresponding amine moieties of formulas (2a), (3), (3a), (3b), (3c), or mixtures thereof.

When the polymer backbone BB is polyisobutylene, the resultant carboxylic functionalized polymer may typically be polyisobutylene succinic anhydride. Typically w, as defined in Formula (1), may be 1 to 5, or 1 to 3 (or as defined in Formula (1a), w may be 0 to 4 or 0 to 2). When BB is other than polyisobutylene and has maleic anhydride (or other carboxylic acid functionality) grafted thereon, one or more of the grafted maleic anhydride groups may be a succinimide formed by reaction with one or more of the aforementioned amines. The number of succinimide groups may be 1 to 40, or 2 to 40, or 3 to 20.

The amine-functionalized carboxylic functionalized polymer may be obtained or obtainable by reacting a carboxylic functionalized polymer derived from maleic anhydride-styrene copolymers, esters of maleic anhydride-styrene copolymers, alpha-olefin maleic anhydride copolymers; or mixtures thereof with an amine having at least 3 or 4 aromatic groups, at least one —$NH_2$ functional group, and at least 2 secondary or tertiary amino groups. Typically the product of this type may be described as an alternating copolymer. Within the alternating copolymer one or more of the maleic anhydride derived groups may be a group represented by Formula (6):

Formula (4)

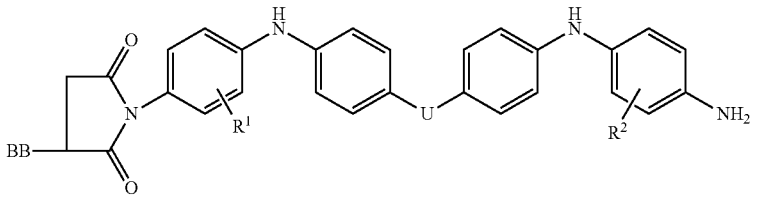

Formula (5)

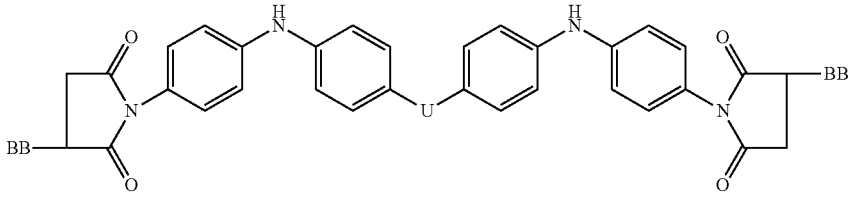

Formula (6)

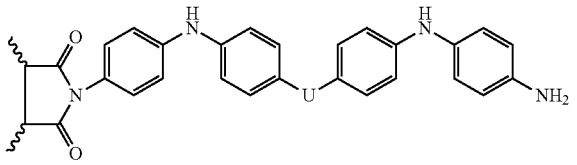

wherein $R^1$, $R^2$ and U are described previously, and the group of Formula (6) may be bonded to further components of the polymer backbone through one or both wavy bonds shown on the succinimide ring structure above. Alternatively, only one wavy bond may attach to the polymer and the second wavy bond may be to a hydrogen atom or other non-polymeric group. The amine-derived group in formula (6) may also be replaced by the any of the above-described amines such as the amine in formula (3), or mixtures thereof.

As an example of suitable structures of an anthranilic derivative derived from polyisobutylene (denoted as "PIB" in Formula (7)), the anthranilic derivative and 4-aminodiphenylamine may be represented by Formula (7):

Formula (7)

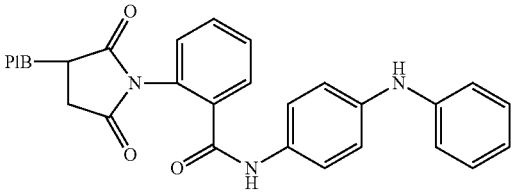

It should be noted that here, as in other dispersants, there are a variety of types of attachments of the succinimide moiety to the polyisobutylene besides a simple single bond, including various cyclic attachment structures, and the structure illustrated is not intended to be limiting.

In one embodiment the amine-functionalized carboxylic functionalized polymer may be derived from one of the aromatic amines and from a non-polyisobutylene polymer backbone. Examples of suitable structures of the anthranilic derivative derived from 4-aminodiphenylamine may be represented by Formula (8):

Formula (8)

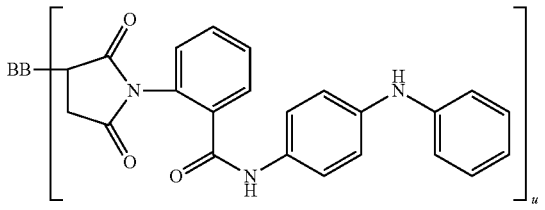

wherein BB, as above, represents a polymer backbone. Typically BB may be an ethylene-propylene copolymer derived from ethylene-propylene copolymers. As shown, BB is grafted with maleic anhydride and functionalized to form the imide group, and u is the number of grafted units shown within the brackets, grafted at various locations on the backbone. Typically u may be 1 to 2000, or 1 to 500, or 1 to 250, or 1 to 50, 1 to 20, 1 to 10, or 1 to 4.

A more detailed description of the amine-functionalized carboxylic functionalized polymer is found in International Application PCT/US2008/082944. In particular see paragraphs [0013] to [0021], [0027] to [0091] and the preparative examples 1 to 25 disclosed in paragraphs [0111] to [0135].

If the carboxylic functionalized polymer is reacted with an aromatic compound containing a hydroxy group, the aromatic group may thereby be joined to the polymer through an ester linkage. A hydroxy-containing aromatic compound may have the hydroxy group located directly on an aromatic ring, thus, as phenoxy group, or alternatively it may be located on a group which in turn is attached to an aromatic group, thus, an alcoholic hydroxy group. The aromatic compound may contain at least 2, 3, or 4 aromatic rings. The ring may be any of the type of aromatic rings as described above and may include fused ring aromatic compounds. Polymeric or oligomeric aromatic compounds may also be used. In one embodiment the product may be obtained or obtainable by reacting a carboxylic functionalized polymer with a hydroxyl-functionalized additive having 2 or more aromatic groups as described in US Patent Publication 2006-0189492, Bera et al, Aug. 24, 2006, see, for example, paragraph 0122. Such materials may be represented by the formula

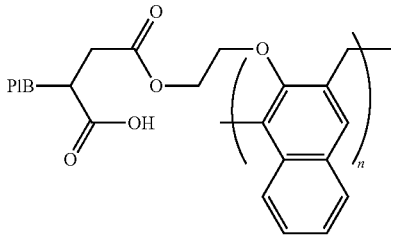

where PIB represents polyisobutylene and n is 2 to 24.

Multiple species of polymeric dispersants of the types described hereinabove may be used in combination, such as mixtures of dispersants based on different polymeric backbones (such as a polyisobutylene backbone and those based on an olefin copolymer backbone), and dispersants having different types of aromatic materials condensed thereon, whether on the same or on different polymer backbones. Thus, for instance, the dispersant component may comprise (i) a polyisobutylene of number average molecular weight of about 500 to about 10,000 bearing at least one succinic anhydride group (optionally, per polymer, averaged over the composition) condensed with an aromatic amine having at least 3 aromatic rings and at least one primary or secondary amino group and (ii) a condensation product of an olefin copolymer bearing multiple carboxylic groups (optionally, per polymer, averaged over the composition) with a nitro-substituted aromatic amine. In one embodiment, the number of succinic anhydride groups or other carboxylic group on the polymer group of the dispersant may be expressed as "per polymer, averaged over the composition." When so expressed, any unreacted portion of the polymer, that is, not being functionalized with a succinic anhydride or other carboxylic group, is included in the calculation. In another embodiment, the number of such groups on the polymer group of the dispersant may be calculated by excluding from the calculation any unfunctionalized (unreacted) polymer chains. The latter mode of calculation is intended in the absence of the expression "per polymer, averaged over the composition." Either characterization may be used.

The amount of the polymeric dispersant in a fully formulated lubricant may be at least 0.2 or 0.3 percent by weight, such as 0.3 to 5 percent or 0.5 to 3 percent or 1 to 2 percent. Alternatively, if the polymeric dispersant is supplied as a concentrate, the amount of dispersant present in the concentrate will be correspondingly higher, such as 2 to 30 percent or 5 to 20 percent.

The compositions of the disclosed technology will also include an oil-soluble titanium compound, which may serve to impart beneficial effects in properties such as deposit control, oxidation, and filterability when used, for instance, in an engine oil. By "oil-soluble" or "hydrocarbon soluble" is meant a material which will dissolve or disperse on a macroscopic or gross scale in an oil or hydrocarbon, as the case may be, typically a mineral oil, such that a practical solution or dispersion can be prepared. In order to prepare a useful lubricant formulation, the titanium material should not precipitate or settle out over a course of several days or weeks. Such materials may exhibit true solubility on a molecular scale or may exist in the form of agglomerations of varying size or scale, provided however that they have dissolved or dispersed on a gross scale.

The nature of the oil-soluble titanium-containing material can be diverse. Various materials that may be useful, as well as methods for their preparation, are disclosed in U.S. Pat. No. 7,727,943, Brown et al., Jun. 1, 2010. Among the titanium compounds that may be used in the present technology are various organic-containing Ti (IV) compounds such as titanium (IV) alkoxides including as titanium methoxide, titanium ethoxide, titanium propoxide, titanium isopropoxide, titanium butoxide, and titanium 2-ethylhexoxide; and other titanium compounds or complexes including but not limited to titanium phenates; titanium carboxylates such as titanium (IV) 2-ethyl-1-3-hexanedioate or titanium citrate or titanium oleate or titanium tartrate; and titanium (IV) (triethanolaminato)isopropoxide. Other forms of oil-soluble titanium include titanium phosphates such as titanium dithiophosphates (e.g., dialkyldithiophosphates) and titanium sulfonates (e.g., alkylsulfonates), or, generally, the reaction product of titanium compounds with various acid materials to form salts, especially oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In another embodiment, the titanium can be supplied as a Ti-modified dispersant, such as a succinimide dispersant. Such materials may be prepared by forming a titanium mixed anhydride between a titanium source such as an alkoxide and a hydrocarbyl-substituted succinic anhydride, such as an alkenyl(or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-)succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 g+diluent oil) at 150° C. for 1.5 hours, to produce a titanium-modified succinimide dispersant. In certain embodiments, titanium compounds such as Ti carboxylates (e.g., citrate, tartrate) may be reacted or combined with a dispersant. Such treatment may improve the solubility properties of the Ti compound.

In one embodiment, the oil-soluble titanium compound may comprise a titanium (IV) alkoxide or carboxylate. A suitable alkoxide is titanium (IV) 2-ethylhexoxide or other alkoxides wherein the alkoxy group may contain 3 to 20 carbon atoms or 4 to 15 or 6 to 12 or 8 carbon atoms. The alkoxy groups may be linear or branched. A suitable carboxylate is titanium (IV) neodecanoate or other carboxylates where the carboxylate group may contain 3 to 20 carbon atoms or 4 to 18 or 6 to 16 or 8 to 12 or 10 carbon atoms. The carboxylate group may be branched or, alternatively, linear.

The oil-soluble titanium compound may be present in the lubricant composition in an amount to provide 5 to 10,000 or to 5000 or to 1000 parts per million by weight (ppm) of titanium, alternatively 10 to 500 ppm or 20 to 400 ppm or 50 to 200 ppm. In other embodiments the amount of titanium may be 5 to 45 ppm. It is believed that cleanliness/anti-fouling/antioxidation benefits may even be obtained at relatively low concentrations of titanium, e.g., 5-100 or 8-50 or 8-45 or 10-45 or 15-30 or 10-25 parts per million of titanium or 1 to less than 50 parts per million, or 8 to less than 50 parts per million by weight Ti, regardless of the anionic portion of the compound. It is believed that amounts in excess of 50 or 70 or 100 parts per million will also be effective.

The titanium compound can be imparted to the lubricant composition in any convenient manner, such as by adding to the otherwise finished lubricant (top-treating) or by pre-blending the titanium compound in the form of a concentrate in an oil or other suitable solvent, optionally along with one or more additional components such as an antioxidant, a friction modifier such as glycerol monooleate, a dispersant such as a succinimide dispersant, or a detergent such as an overbased sulfurized phenate detergent. Such additional components, typically along with diluent oil, may typically be included in an additive package, sometimes referred to as a DI (detergent-inhibitor) package.

Additional conventional components may be used in preparing a lubricant according to the present invention, for instance, those additives typically employed in a crankcase lubricant. Crankcase lubricants may typically contain any or all of the following components hereinafter described. One such additive is an ashless dispersant or polymeric dispersant other than the condensation product as described above, that is, other than a condensation product of a carboxylic-functionalized polymer with an aromatic moiety. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

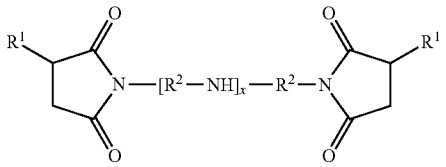

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. When x is 1, the amine-derived portion of the molecule may correspond to diethylene triamine; when x is 2, triethylene tetramine; when x is 3, tetraethylene pentamine. Values of x may be 1 to 8 or 2 to 6 or 3 to 4. Such molecules are commonly derived from reaction of an alkenyl acylating agent with a polyamine, and a wide variety of linkages between the two moieties is possible beside the simple imide structure shown above, including a variety of amides and quaternary ammonium salts. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Certain of these materials may also be described as being the condensation product of a hydrocarbyl-substituted succinic anhydride or reactive equivalent thereof with a poly (alkyleneamine). Succinimide dispersants are more fully described in U.S. Pat. Nos. 4,234,435 and 3,172,892 and in EP 0355895. These dispersants may be similar to those described above except that they typically would not comprise an aromatic moiety.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

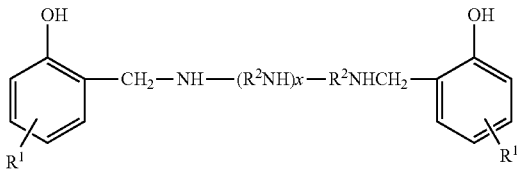

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer. These may, again, be similar to the dispersants of the technology disclosed above, except that they will generally not comprise the required aromatic component.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of such other or supplemental dispersant, if present, may be 0.1 to 8 percent by weight of the lubricant, or 0.5 to 5, or 1 to 4, or 2 to 3 percent.

Another additive which may be present is a detergent, typically, a metal-containing detergent. Most conventional detergents, as used in the field of engine lubrication, provide basicity or TBN to the lubricant, due to the presence of basic metal compounds (metal hydroxides, oxides, or carbonates, typically based on such metals as calcium, magnesium, or sodium). Such metallic overbased detergents, also referred to as overbased or superbased salts, are generally single phase, homogeneous Newtonian systems characterized by a metal content in excess of that which would be present for neutralization according to the stoichiometry of the metal and the particular acidic organic compound reacted with the metal. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. In one embodiment, the lubricant composition may comprise an overbased detergent having a metal ratio of at least 3, at least 5, at least 8, or at least 10 and up to, for instance, 20 or 15 or 12 or 10.

The overbased materials are typically prepared by reacting an acidic material (typically an inorganic acid or lower carboxylic acid such as carbon dioxide) with a mixture of an acidic organic compound (also referred to as a substrate), a stoichiometric excess of a metal base, typically in a reaction medium of an one inert, organic solvent (e.g., mineral oil, naphtha, toluene, xylene) for the acidic organic substrate. Optionally a small amount of promoter such as a phenol or alcohol is present. The acidic organic substrate will normally have a sufficient number of carbon atoms to provide a degree of solubility in oil.

The acidic organic substrate may comprise a sulfonic acid such as, e.g., a hydrocarbyl-substituted benzenesulfonic acid, providing a sulfonate detergent, a carboxylic acid, providing a carboxylate detergent (a species of which are salicylate detergents), a phenol or a sulfur-bridged phenol, providing a phenate detergent, or a phosphonic acid, providing a phosphonate detergent. Other types of detergents include salixarate and saligenin detergents. Such overbased materials and their methods or preparation are well known to those skilled in the art. Patents describing techniques for making basic metallic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate detergents are described in U.S. Pat. No. 6,200,936 and PCT Publication WO 01/56968. Saligenin detergents are described in U.S. Pat. No. 6,310,009. In some embodiments the detergent may comprise an overbased sulfurized phenate detergent, which may be present in an amount of 0.1 to 2 percent by weight or 0.2 to 1 percent or 0.4 to 0.8 percent. In some embodiments the detergent may comprises a sulfonate detergent, which may be present in an amount of 0.1 to 2 percent by weight or 0.2 to 1 percent or 0.5 to 0.9 percent. In certain embodiments both a sulfurized phenate detergent and a sulfonate detergent may be present, in a total amount of 0.2 to 4 percent by weight, or 0.5 to 2.5 percent or 1.0 to 1.5 percent.

Another component may be an antioxidant. Antioxidants encompass phenolic antioxidants, which may comprise a butyl substituted phenol containing 2 or 3 t-butyl groups. The para position may also be occupied by a hydrocarbyl group or a group bridging two aromatic rings. The latter antioxidants are described in greater detail in U.S. Pat. No. 6,559,105. A specific and useful type of phenolic antioxidant is a hindered phenolic ester, which may have the general structure

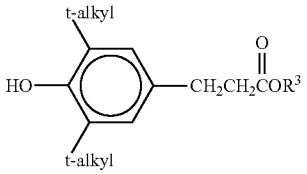

wherein $R^3$ is a hydrocarbyl group such as an alkyl group containing, e.g., 1 to 18 or 2 to 12 or 2 to 8 or 2 to 6 carbon atoms, e.g., 4 or 8 carbon atoms; and t-alkyl can be t-butyl. Such antioxidants and their preparation are described in greater detail in U.S. Pat. No. 6,559,105.

Antioxidants also include aromatic amines, such as alkylated diphenylamines and alkylated phenylnaphthylamines, including phenyl-α-naphthylamine ("PANA") and alkylated PANA. Typical alkylated diphenylamines include nonylated diphenylamine. The aromatic amine antioxidants, as described herein, would typically be non-polymeric antioxidants, as distinguished from the polymeric aromatic-containing materials of the technology described hereinabove, some of which may exhibit some antioxidant activity. Other antioxidants include sulfurized olefins, titanium compounds, and molybdenum compounds. U.S. Pat. No. 4,285,822, for instance, discloses lubricating oil compositions containing a molybdenum and sulfur containing composition. U.S. Patent Application Publication 2006-0217271 discloses a variety of titanium compounds, including titanium alkoxides and titanated dispersants, which materials may also impart improvements in deposit control and filterability. Typical amounts of antioxidants will, of course, depend on the specific antioxidant and its individual effectiveness, but illustrative total amounts can be 0.01 to percent by weight or 0.05 to 3 percent or 0.1 to 1 percent or 0.2 to 0.5 percent or 0.15 to 4.5 percent or 0.2 to 4 percent. Additionally, more than one antioxidant may be present, and certain combinations of these may be synergistic in their combined overall effect.

Viscosity improvers (also sometimes referred to as viscosity index improvers or viscosity modifiers) may be included in the compositions of this technology. Viscosity improvers are usually polymers, including polyisobutenes, polymethacrylic acid esters, hydrogenated diene polymers, polyalkylstyrenes, esterified styrene-maleic anhydride copolymers, hydrogenated alkenylarene-conjugated diene copolymers, and polyolefins. Multifunctional viscosity improvers, which also have dispersant and/or antioxidancy properties are known and may optionally be used.

Another possible additive is an antiwear agent. Examples of anti-wear agents include phosphorus-containing antiwear/extreme pressure agents such as metal thiophosphates, phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent phosphorus. Often the antiwear agent is a zinc dialkyldithiophosphate (ZDP). For a typical ZDP, which may contain 11 percent P (calculated on an oil free basis), suitable amounts may include 0.09 to 0.82 or to 1.0 percent. Non-phosphorus-containing anti-wear agents include borate esters (including borated epoxides), dithiocarbamate compounds, molybdenum-containing compounds, and sulfurized olefins.

Other types of antiwear agents include tartrate esters, tartramides, and tartrimides, such as oleyl tartrimide, as well as esters, amides, and imides of hydroxy-polycarboxylic acids in general. These materials may also impart additional functionality to a lubricant beyond antiwear performance. These materials are described in greater detail in US Publication 2006-0079413 PCT Publication WO2010/077630.

The lubricant may also contain a metal salt of a phosphorus acid. Metal salts of the formula $[(R^8O)(R^9O)P(=S)—S]_n$-M where $R^8$ and $R^9$ are independently hydrocarbyl groups containing 3 to 30 carbon atoms, are readily obtainable by heating phosphorus pentasulfide ($P_2S_5$) and an alcohol or phenol to form an O,O-dihydrocarbyl phosphorodithioic acid. The alcohol which reacts to provide the $R^8$ and $R^9$ groups may be a mixture of alcohols, for instance, a mixture of isopropanol and 4-methyl-2-pentanol, and in some embodiments a mixture of a secondary alcohol and a primary alcohol, such as isopropanol and 2-ethylhexanol. The resulting acid may be reacted with a basic metal compound to form the salt. The metal M, having a valence n, generally is aluminum, lead, tin, manganese, cobalt, nickel, zinc, or copper, and in many cases, zinc, to form zinc dialkyldithiophosphates. Such materials are well known and readily available to those skilled in the art of lubricant formulation. Suitable variations to provide good phosphorus retention in an engine are disclosed, for instance, in US published application 2008-0015129, see, e.g., claims.

Other additives that may optionally be used in lubricating oils include pour point depressants, extreme pressure agents, anti-wear agents, color stabilizers, and anti-foam agents.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The presently-described lubricants may be used to lubricate a mechanical device, by supplying the lubricant to the device. The device may be an internal combustion engine such as a gasoline-fired or diesel-fired automobile engine, a heavy duty diesel engine, a marine diesel engine, or a stationary gas engine. Such engines may be sump lubricated, and the lubricant may be provided to the sump from whence it may lubricate the moving parts of the engine. Alternatively, the lubricant may be supplied from a separate source, not a part of a sump.

EXAMPLES

A series of lubricant formulations are prepared containing the following components, given as percent by weight:

2.19% Overbased calcium sulfonate and phenate detergents (including about 40% diluent oil)

1.1% Zinc dialkyldithiophosphate (including 9% oil)

1.5% Dispersant viscosity modifier, containing an aromatic nitrogen compound component (including 66.5% diluent oil)

0.5% Hindered phenolic ester antioxidant 0.3% Aromatic amine antioxidant 0.1% Hydrocarbyl-substituted succinic anhydride Lesser amounts of corrosion inhibitor(s) and antifoam agent(s)

Additional components—see below

Base oil of lubricating viscosity—Group II base oil in an amount to =100%

Six specific lubricant formulations are prepared by including, along with the above components, those materials listed in the table below, in the amounts indicated. Each lubricant formulation is subjected to an Oxidation Induction Time test by ACEA E-5 Pressurized Differential Scanning Calorimetry. In this test, a sample of lubricant is heated in a pressure cell capable of pressurization to 700 kPa (100 psi), supplied with compressed air. Following equilibration at 50° C., the temperature is increased to 210° C. at 40° C. per minute and maintained at 210° C. until an oxidation event is detected by heat flow. The oxidation induction time is the time, starting when 100° C. is reached, until the onset of the oxidation event. Results are reported in minutes to oxidation onset. Longer times indicate greater stability.

| Example | Additional component(s) | % component | OIT (min) |
|---|---|---|---|
| C1 | Succinimide dispersant, from poly (ethyleneamines), incl. 50% oil | 4% | 90 |
| C2 | Succinimide dispersant, from poly-(ethyleneamines), incl. 50% oil | 7% | 82 |
| C3 | Succinimide dispersant, from poly-(ethyleneamines), incl. 50% oil | 4% | 96 |
| | Succinimide dispersant, from aromatic amine, incl. 50% oil | 3% | |
| C4 | Succinimide dispersant, from poly-(ethyleneamines), incl. 50% oil | 4% | 127 |
| | Tetra(2-ethylhexyl)titanate | 0.12% | |
| C5 | Succinimide dispersant, from poly-(ethyleneamines), incl. 50% oil | 7% | 122 |
| | Tetra(2-ethylhexyl)titanate | 0.12% | |
| 6 | Succinimide dispersant, from poly-(ethyleneamines), incl. 50% oil | 4% | 164 |
| | Succinimide dispersant, from aromatic amine, incl. 50% oil | 3% | |
| | Tetra(2-ethylhexyl)titanate | 0.12% | |

In the above table, examples C1 through C5 are comparative or reference examples. The succinimide dispersant from aromatic amine is a polyisobutene-substituted succinimide condensation product with an aromatic amine comprising, in large part, molecules believed to have the structure of Formula (2), above, including isomers thereof. Tetra(2-ethylhexyl)titanate is used in an amount to provide 100 ppm Ti to the lubricant.

The results show that the presence or absence of either the aromatic succinimide dispersant or of the conventional poly (ethyleneamine) based succinimide dispersant have little effect on oxidative stability (Compare Examples C1, C2, and C3). The addition of 100 ppm soluble titanium to the lubricants of C1 and C2 leads to a modest increase in stability of about 41 to 49%, in terms of OIT (compare C4 with C1 and C5 with C2). However, when 100 ppm of titanium is added to a lubricant that also contains the aromatic succinimide dispersant, the OIT is increased by over 70% to a value in excess of 160 minutes (compare Example 6 with C2). This represents a significant and unexpected improvement in oxidative stability.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition, comprising:

(a) an oil of lubricating viscosity;

(b) a dispersant comprising the condensation product of a carboxylic-functionalized polymer with an aromatic moiety through an amide, imide, or ester linkage; wherein the dispersant comprises a condensation product with an aromatic amine having at least 3 aromatic rings and at least one primary or secondary amino group; and (c) an oil-soluble titanium compound.

2. The lubricant composition of claim 1 wherein the aromatic amine is represented by the structure

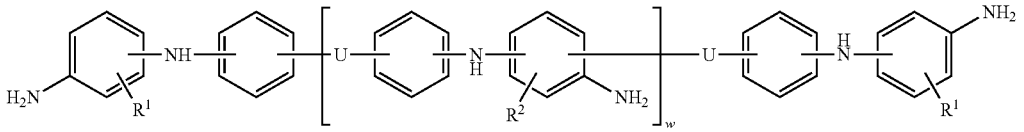

wherein independently each variable $R^1$ and $R^2$ are hydrogen or $C_{1-5}$ alkyl groups;

U is an aliphatic, alicyclic, or aromatic group; and w is zero to about 9.

3. The lubricant composition of claim 1 wherein the dispersant comprises a condensation product with a nitro-substituted aromatic amine.

4. The lubricant composition of claim 1 wherein the carboxylic-functionalized polymer comprises a polyisobutylene moiety of number average molecular weight of about 500 to about 10,000 bearing at least one succinic anhydride group.

5. The lubricant composition of claim 1 wherein the carboxylic-functionalized polymer comprises an olefin copolymer bearing multiple carboxylic groups.

6. The lubricant composition of claim 1 wherein the amount of the dispersant of (b) is about 0.2 to about 5 percent by weight.

7. The lubricant composition of claim 1 wherein the dispersant of (b) comprises (i) a polyisobutylene moiety of number average molecular weight of about 500 to about 10,000 bearing at least one succinic anhydride group condensed with an aromatic amine having at least 3 aromatic rings and having at least one primary or secondary amino group and (ii) a condensation product of an olefin copolymer bearing multiple carboxylic groups with a nitro-substituted aromatic amine.

8. The lubricant composition of claim 1 wherein the oil-soluble titanium compound comprises a titanium (IV) alkoxide or carboxylate.

9. The lubricant composition of claim 1 wherein the oil-soluble titanium compound comprises titanium (IV) 2-ethylhexoxide.

10. The lubricant composition of claim 1 wherein the oil-soluble titanium compound comprises titanium neodecanoate.

11. The lubricant composition of claim 1 wherein the oil-soluble titanium compound is present in an amount to provide about 5 to about 10,000 parts per million by weight titanium.

12. The lubricant composition of claim 1 further comprising about 0.5 to about 5 percent by weight of an ashless dispersant or polymeric dispersant other than a condensation product of a carboxylic functionalized polymer with an aromatic moiety.

13. The lubricant composition of claim 12 wherein the polymeric dispersant other than a condensation product of a carboxylic functionalized polymer with an aromatic moiety comprises a condensation product of a hydrocarbyl-substituted succinic anhydride or reactive equivalent thereof with a poly(alkyleneamine).

14. The lubricant composition of claim 1 further comprising about 0.05 to about 3 percent by weight of a non-polymeric aromatic amine antioxidant.

15. The lubricant composition of claim 1 further comprising at least one additive selected from the group consisting of viscosity modifiers, pour point depressants, metal-containing detergents, zinc dialkyldithiocarbamates, and anti-wear agents.

16. A composition prepared by admixing the components of claim 1.

17. A method for lubricating a mechanical device comprising supplying to said device the lubricant composition of claim 1.

18. The method of claim 17 wherein the mechanical device is an internal combustion engine.

19. A method for improving the oxidative stability of a lubricant for a mechanical device, comprising including within said lubricant (b) a dispersant comprising the condensation product of a carboxylic-functionalized polymer with an aromatic moiety through an amide, imide, or ester linkage; wherein the dispersant comprises a condensation product with an aromatic amine having at least 3 aromatic rings and at least one primary or secondary amino group; and (c) an oil-soluble titanium compound.

* * * * *